US005220753A

United States Patent [19]

Whitman

[11] Patent Number: 5,220,753

[45] Date of Patent: Jun. 22, 1993

[54] SAFETY VACUUM SHIELD FOR FLEXIBLE CABLE AND MOTOR TOOL

[76] Inventor: Robert S. Whitman, 2714 Northview Rd., Philadelphia, Pa. 19152

[21] Appl. No.: 893,336

[22] Filed: Jun. 3, 1992

Related U.S. Application Data

[63] Continuation-in-part of Ser. No. 577,587, Sep. 4, 1990, Pat. No. D. 333,019.

[51] Int. Cl.[5] ..... B24B 55/06

[52] U.S. Cl. ..... 51/273

[58] Field of Search ..... 51/273, 268, 270, 170 PT, 51/170 R

[56] References Cited

U.S. PATENT DOCUMENTS

| | | | |
|---|---|---|---|
| D. 242,212 | 11/1976 | Parise et al. | D32/32 |
| D. 253,596 | 12/1979 | Nauta | D32/32 |
| D. 262,708 | 1/1982 | Essex | D32/32 |
| 1,093,049 | 4/1914 | Hawley | 51/273 |
| 3,126,021 | 3/1964 | May | 51/273 |
| 4,226,054 | 10/1980 | Coty | 51/273 |
| 4,409,699 | 10/1983 | Moorhouse | 51/273 |
| 4,446,593 | 5/1984 | Bell et al. | D32/32 |
| 4,788,797 | 12/1988 | Kane et al. | 51/273 |

*Primary Examiner*—Roscoe V. Parker

*Attorney, Agent, or Firm*—Frank M. Linguiti

[57] ABSTRACT

The safety vacuum shield of the present disclosure may be detachably secured to a hand held power tool for removing particulate materials while performing work upon a workpiece with the power tool. Applying the power tool to the workpiece generates turbulence which moves the particulate materials, including particles of the workpiece as well as the tool bit. The safety vacuum attachment includes a shield for containing the turbulence and the moving particulate materials within an interior region defined by the shield when the power tool is in use. A first opening through the shield permits the power tool to extend therethrough and into the interior region. A second opening through the shield permits a vacuum to be applied to the interior region for providing a vacuum slip stream to draw materials within the slip stream from the interior region by way of the second opening. The shield is formed in a generally cup-shaped manner with arcuate turbulence control edges for confining the turbulence caused by applying the tool to the workpiece, and for applying the moving particulate material to the intervening vacuum slip stream where the turbulence is broken for removing the particulate materials from the interior region defined by the shield.

9 Claims, 1 Drawing Sheet

SAFETY VACUUM SHIELD FOR FLEXIBLE CABLE AND MOTOR TOOL

This patent application is a continuation-in-part of U.S. patent application Ser. No. 07/577,587 filed on Sep. 4, 1990 by Robert S. Whitman, and now U.S. Pat. No. Des. 333,019.

BACKGROUND OF THE INVENTION

1. Field of the Invention

This invention relates to the field of rotary power carving tools, and in particular, to a safety shield for a rotary power carving tool.

2. Background Art

When using hand held power tools to carve or grind materials, such as wood, toxic material and flying particles of carbide bur may be produced. These particulate materials may be breathed into the lungs of the user or deposited onto the skin of the user, causing irritation and possible health hazards. Additionally, these particulate materials may adhere to the tool and clog the tip. Therefore dust masks, long-sleeves, hats, aprons, gloves and goggles are often required when using these devices in order to protect the user and frequent interruptions in the use of the tool are often required for cleaning and maintenance in order to protect the tool.

Thus it is advantageous to remove the particulate materials produced by power tools in order to prevent them from being deposited on the user or on the tool. It is known in the art to provide dust boxes which include exhaust filters for this purpose. However, these dust boxes do not eliminate all the particulate materials and they clog quickly. Because of the tendency to clog quickly they require constant emptying when these power tools are operated. Additionally, the usefulness of these devices is limited because they are not portable.

It is also known in the art to provide portable safety shields which may be directly attached to hand held power tools to help protect users from particulate materials. Additionally, it is known to provide a combination safety shield and particulate collection attachment. These devices permit more convenient use of power hand tools in locations where it is not possible to use dust boxes.

For example, U.S. Pat. No. 3,256,648, issued to Subonovich, discloses such a shield and particulate collection attachment. The particulate collection attachment of Subonovich has an opening from which an upwardly extending hollow sphere is mounted for movement within a socket. The socket is adapted to mate with a motor for driving a sanding disk. The particulate collecting attachment taught by Subonovich is also provided with an opening extending into a fitting which terminates a circular pipe section. The pipe section is adapted to be connected to a vacuum hose in order to remove the particulate materials created by use of the power tool. Thus the device taught by Subonovich is adapted to remove particulate materials by means of a vacuum.

U.S. Pat. No. 4,124,956, issued to Levinson, discloses a portable rotary bur which is releasably secured within a vacuum shroud. A vacuum tube is coupled to the vacuum shroud for removing particulate materials. However the vacuum shroud of Levinson is formed with a flared mouth portion which does not extend to the cutting bur end. Therefore as particulate materials are created at the bur end and accelerated, a substantial portion may be propelled away from the shroud because no vacuum is applied to them.

In order to solve this problem, the source may be applied at the actual point of work. For example, U.S. Pat. No. 4,245,437, issued to Marton, discloses a spring loaded telescoping tubular vacuum housing for a hand held power tool. When the vacuum housing is connected to a vacuum source the device taught by Marton is adapted to remove loose material created by grinding. As a grinding bit sinks deeper into a work piece the telescoping portion retracts. Thus a vacuum seal is preserved. However, the device taught by Marton is not effective for tools which must be operated at varying angles with respect to the workpiece, for example, with wood carving.

When using portable vacuum shield devices for hand held power tools a vacuum hose may be used to apply a vacuum, from a suitable vacuum source, to the vacuum shield. It is often necessary to couple the vacuum hose to vacuum sources having differing size mating openings for receiving the hose. Thus it is useful to have a single mating device for coupling the hose to any one of a large number of mating openings. A device for this purpose is taught in U.S. Pat. No. 4,997,209, issued to McGrath. McGrath discloses a hollow tapered sleeve that is provided with a series of different sized and tapered portions of varying lengths and angles which enable the sleeve to be used with a variety of inlet valves. Additionally, U.S. Pat. No. 4,101,149, issued to Fleischer teaches a coupling device which may be used to couple vacuum hoses to vacuum sources of varying sizes.

SUMMARY OF THE INVENTION

The safety vacuum shield of the present invention may be detachably secured to a hand held power tool for removing particulate materials while performing work upon a workpiece with the power tool. Applying the power tool to the workpiece generates turbulence which moves the particulate materials, including particles of the workpiece as well as the tool bit. The safety vacuum attachment includes a shield for containing the turbulence and the moving particulate materials within an interior region defined by the shield when the power tool is in use. A first opening through the shield permits the power tool to extend therethrough and into the interior region. A second opening through the shield permits a vacuum to be applied to the interior region for providing a vacuum slip stream to draw materials within the slip stream from the interior region by way of the second opening. The shield is formed in a generally cup-shaped manner with arcuate turbulence control edges to confine vacuum pressure and for breaking the turbulence caused by applying the tool to the workpiece by the intervening vacuum slip stream and for applying the moving particulate material to the vacuum slip stream for removing the particulate materials from the interior region defined by the shield.

DETAILED DESCRIPTION OF THE INVENTION

Figure 1:
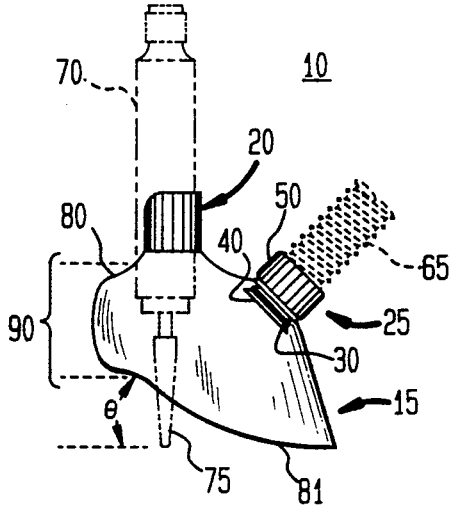
FIGS. 1-5 show varying views of the safety vacuum shield for a flexible cable and motor tool of the present invention.
Figure 2:
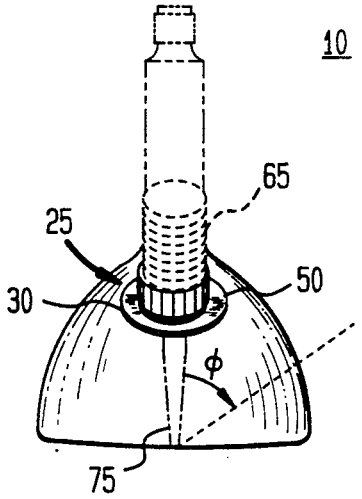
Figure 3:
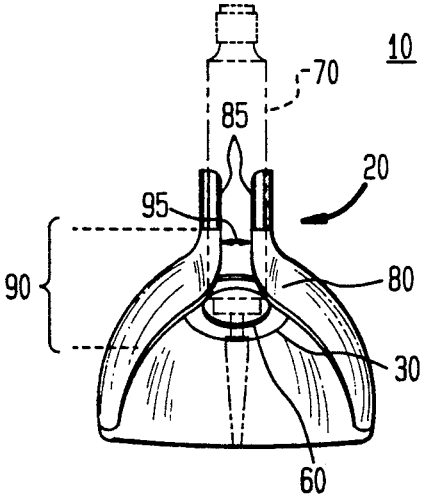
Figure 4:
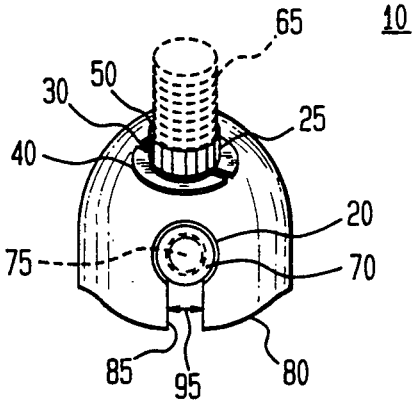
Figure 5:
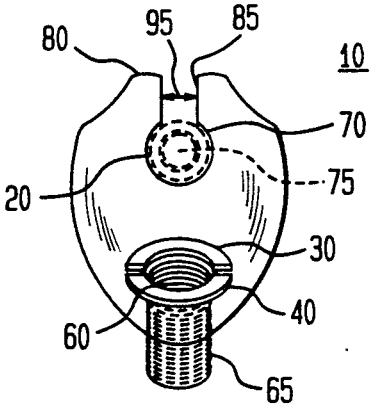

Referring now to FIGS. 1-5, there are shown varying views of hand held power tool safety vacuum shield 10 of the present invention. Hand held power tool safety vacuum shield 10 is adapted to protect a user of hand held power tool 70 from particulate materials created by the operation of hand held power tool 70 while permitting the user to view the workpiece (not shown) and avoid damage to the workpiece.

Hand held power tool safety vacuum shield 10 of the present invention is formed as a substantially spherical dome 15 which defines an interior region containing work attachment 75. This interior region is evacuated by a vacuum source (not shown) by way of flexible vacuum hose 65 when power tool 70 is in operation. Spherical dome 15 may be most advantageously formed of a clear transparent resin to permit the user of power tool 70 to observe bit 75 and the workpiece within the interior region through dome 15 while operating power tool 70.

Spherical dome 15 is provided with integral molded resin gripping boss 20 which is disposed toward the bottom of safety vacuum shield 10 when vacuum shield 10 is in use. Gripping boss 20 is an approximately three-quarters closed resilient tubular structure for detachably coupling and flexibly securing safety vacuum shield 10 to a flexible cable hand piece portion of power tool 70, the housing of power tool 70, or another region of power tool 70. Thus hand held power tool 70, and work attachment 75 extending from power tool 70, may extend through gripping boss 20 of spherical dome 15 and into the interior region defined by spherical dome 15.

Resiliently spreadable edges 85 of gripping boss 20 are adapted to resiliently spread away from each other in order to further expand expandable opening 95 as hand tool 70 is forced between edges 85 and to resiliently close around power tool 70 when power tool 70 is seated within gripping boss 20. As gripping boss 20 of spherical dome 15 resiliently grips power tool 70, safety vacuum shield 10 is secured to power tool 70 by both the resilient compression of gripping boss 20 and by the resulting friction between gripping boss 20 and power tool 70.

Figure 6:
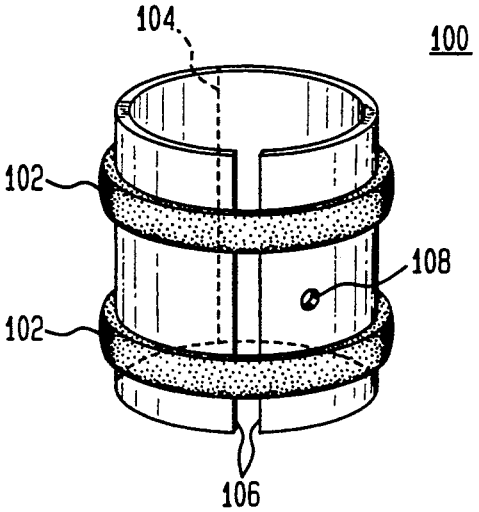
FIG. 6 shows a variable size collar accessary for adapting the safety vacuum shield of FIGS. 1-5 to a plurality of differing hand pieces.

In an alternate embodiment, split hinged adapter bushing 100 or split hinged sizing bushing 100 of FIG. 6 may be used with vacuum safety shield 10. Split hinged adapter bushing 100 is effective to adapt vacuum safety shield 10 to power tools 70 having differing diameters. In particular, bushing adapter 100 or sizing adapter 100 is effective to adapt vacuum safety shield 10 to power tools 70 which are narrower than boss 20.

Hinged bushing 100 or variable sized bushing 100 is provided with scored hinge 104 to facilitate the spreading of bushing edges 106 to permit power tool 70 to pass therebetween. Additionally bushing opening 108 is provided to mateably receive an adjusting screw (not shown) which may be present on power tool 70. The detachable mating of power tool 70 and bushing 100, by means of opening 108, helps prevent bushing 100 from axially or rotationally sliding along power tool 70.

In an alternate embodiment axial and rotational sliding of bushing 100 on power tool 70 may be prevented by applying a double sided adhesive tape (not shown) to power tool 70 and applying bushing 100 to the double sided adhesive. Elastic bands 102 may also be provided around bushing 100 to cause bushing 100 to more tightly grip power tool 70. Gripping boss 20 may then be applied to hinged bushing 100. Thus vacuum shield 10 may be secured to power tools 70 having a diameter too small to be gripped by gripping boss 20 alone by first applying brushing 100 to power tool 70.

Extending from the region of gripping boss 20 are resiliently spreadable arcuate edges 80. Generally defined by arcuate edges 80 within the interior region of spherical dome 15 and extending in the direction along the axis of power tool 70, is partially open generally cup-shaped region 90. Resiliently expandable gap 95 or expandable opening 95 of region 90 is formed between edges 80 which oppose each other across gap 95 and extend toward each other across gap 95. The extension of arcuate edges 80 of cup shaped region 90 as shown is adapted to confine the turbulence within the interior region of safety shield 10 in a manner adapted to effectively cause removal of particulate materials by the vacuum.

Vacuum opening 60 of safety vacuum shield 10 is provided through a portion of spherical dome 15 toward top of shield 10 when shield 10 is in use. Vacuum opening 60 permits vacuum attachment coupling 25 to attach safety vacuum shield 10 to a vacuum source (not shown) by way of flexible vacuum hose 65. The angle between a cylindrical axis of attachment coupling 25 and a cylindrical axis of boss 25 is oblique. The vacuum applied to the interior region defined by spherical dome 15 is effective to create a vacuum slip stream within the interior region of spherical dome 15 for removing particulate materials in the slip stream from the interior region by way of vacuum opening 60.

Male portion 30 of vacuum attachment coupling 25 may be snap inserted into vacuum opening 60 of spherical dome 15 with a tolerance effective to allow male portion 30 of vacuum coupling 25 to swivel within vacuum opening 60 without becoming detached from spherical dome 15. This permits convenient movement of power tool 70 and safety vacuum shield 10 with respect to flexible vacuum hose 65 and the vacuum source during operation of power tool 70.

Vacuum attachment coupling 25 of vacuum safety shield 10 may be formed as a separate two piece unit including male portion 30 and female portion 50. Male portion 30 of vacuum attachment coupling 25 may be formed as a short tubular region with a flat flange on which tightening slot 40 is provided. A small ring (not shown) may be molded around the short tubular region of male portion 30, a distance from the flat flange equal to the thickness of the material forming spherical dome 15. The end of the tubular region of male portion 30 opposite the flange is molded with an external thread in order to threadably mate with female portion 50.

Female portion 50 of vacuum attachment coupling 25 is molded in the form of a short tube with an internal thread to threadably mate with male portion 30. A series of external ridges may be disposed upon the outer surface of female portion 50 in order to facilitate a friction grip press fit of flexible vacuum hose 65 which may be attached to coupling 25 in this manner. The threaded portions of vacuum attachment coupling 25 permits quick attachment and disconnection. Additionally, a key (not shown) or a coin (not shown) may be engaged within tightening slot 40 of male portion 30 in order to turn male portion 30 of coupling 25 counter clockwise and tighten coupling 25.

In an alternate embodiment (not shown) a conventional hose coupling (not shown) may be used wherein left handed internal threading is provided on the hose end and a non-threaded cuff (not shown) is press fitted onto male portion 30. In this alternate embodiment an adhesive may be applied to this fitting to provide a tight seal. Tightening slot 40 is not required in this press fit embodiment and the thread on coupling 25 is reversed relative to the embodiment shown. The threads on male portion 30 may be maintained within this alternate embodiment in order to act as barbs to assist in the friction fit of the cuff. However, it will be understood that the threads are not necessary and that male portion 30 may be formed with barbs instead of threads.

As previously described, safety vacuum shield 10 of the present invention may be used by (1) snapping vacuum shield 10 onto a flexible shaft hand piece of power tool 70 or directly onto the housing or other region of power tool 70, and (2) coupling flexible vacuum hose 65 to vacuum attachment coupling 25 and to a suitable vacuum source in order to create a vacuum slip stream for evacuation of the interior region of safety vacuum shield 10. When power tool 70 thus fitted with vacuum shield 10 is in operation and fitted with an abrading bur, bit, drill or abrader such as work attachment 75, spherical dome 15 substantially captures and confines the turbulent air stream caused thereby and the moving particulate materials formed thereby within vacuum shield 10.

It is the high speed movement of work attachment 75 within the interior region of safety shield 10 that causes the turbulence which tends to cause the particulate materials to swirl within the interior of vacuum shield 10. Cup-shaped region 90, including arcuate edges 80 or curved edges 80 of safety vacuum shield 10 is adapted to be effective to confine vacuum pressure and break this turbulence and to apply the particulate material to the intervening vacuum slip stream for removal from the interior region of vacuum shield 10 by the vacuum slip stream.

The vacuum slip stream applied to the interior region of safety vacuum shield 10 is then effective to remove the particulate materials produced by power tool 70. It is believed that the shape of arcuate turbulence control edges 80 curving toward each other across opening 95 is important for confining the turbulence to make shield 10 effective to remove the particulate material because it was determined that the material was not removed satisfactorily from the interior region of vacuum shield 10 at low pressure without curved edges 80. The transparency of dome 15 of safety vacuum shield 10 protects the user from flying particulate matter while allowing the user to see the workpiece.

It will be understood that when safety shield 10 is used at a relatively small angle $\theta$ between attachment 75 within safety shield 10 and a workpiece, the shape of shield 10 in the region between point 81 and edges 80 permits attachment 75 to extend beyond the edge of shield 10 and come in contact with the workpiece while still permitting turbulence control edges 80 of safety shield 10 to be adapted to remove the particulate matter generated thereby. At these small values of $\theta$ the point of contact between attachment 75 and the workpiece is not in the interior region of shield 10 but edges 80 are shaped and positioned such that the particulate materials are still directed to the vacuum slip stream. It will also be understood that safety shield 10 is shaped to permit contact between attachment 75 and the workpiece at small values of $\Theta$ when angle $\phi$ between shield 10 and the workpiece is varied.

Thus safety vacuum shield 10 may be used to provide the benefits of a cleaner work area as well to eliminate many of the health hazards due to air borne pollutants. This results in protection of the lungs and eyes of the user from injury.

It will be understood by those skilled in the art that this shape may be substantially a Hogarth curved arcuate. This allows for close tool bur contact with rounded surfaces without loss of vacuum pressure. It also provides a spacing between the workpiece and a portion of the edges of safety shield 10 for draft access when working on flat planes if the shield edges are disposed in direct contact with the workpiece. This type of positioning and contact may be found, for example, in a background routing operation in relief sign carving.

In this type of routing procedure, vacuum safety shield 10 may act as a depth gauge wherein the amount of material removed from the surface of a work piece is limited to the amount of exposure of attachment 75 permitted by the angle between attachment 75 and the work piece. This exposure is controlled by the length of the arcuate edge of vacuum shield 10 in contact with the work piece.

Additionally, the Hogarth curve arcuate provides a vacuum draft space which permits the air intake of safety vacuum shield to draw particulate materials off the workpiece surface and clear the workpiece surface. This prevents the detailed lines of the work piece from being obscured by the particulate matter while carving the surface of the work piece. Vacuum safety shield 10 is thus formed in such a way as to clear the workpiece as well as confine the turbulent particulate materials produced by the bur. The turbulence is broken within shield 10 by the intervening oblique vacuum slip stream and the materials cleared from the work piece are channeled into exhaust cable 65.

It will be understood that various changes in the details, materials and arrangements of the parts which have been described and illustrated in order to explain the nature of this invention may be made by those skilled in the art without departing from the principle and scope of the invention as expressed in the following claims.

What is claimed is:

1. A safety vacuum attachment having a generally cup shaped safety shield means formed to define a shield interior region for use with a power tool having a point of work at which said power tool makes contact with a workpiece thereby generating turbulence which moves particulate material during operation of said power tool, comprising:

a first tool opening through said safety shield for permitting said motor tool to extend therethrough and into shield said interior region;

a second vacuum opening through said safety shield for applying a vacuum to said shield interior region to provide a vacuum intervening slip stream to said shield interior region for drawing said moving particulate material within said slip stream from said shield interior region by way of said vacuum second opening; and, said safety shield means having a turbulence control gap with opposing arcuate turbulence control edges curving toward each other across said turbulence control gap, said arcuate turbulence control edges being formed to curve toward each other in a shape adapted to substantially confine said turbulence and apply said moving particulate material to said vacuum intervening slip stream for removing said moving particulate material from said shield interior region.

2. The safety vacuum attachment of claim 1, wherein said safety shield means is formed of a clear plastic.

3. The safety vacuum attachment of claim 1, wherein said first tool opening is provided with gripping means for gripping said motor tool.

4. The safety vacuum attachment of claim 3, further comprising bushing means for permitting said gripping means to grip motor tools having substantially small diameters.

5. The safety vacuum attachment of claim 3, wherein said gripping means is provided with resiliently spreadable edges for permitting said motor tool to pass therebetween.

6. The safety vacuum attachment of claim 1, wherein said arcuate turbulence control edges are resiliently spreadable away from each other thereby enlarging said turbulence control gap.

7. The safety vacuum attachment of claim 1, wherein said second vacuum opening is provided with vacuum coupling means for coupling said safety shield means to a vacuum source.

8. The safety vacuum attachment of claim 7, wherein said power tool and said vacuum coupling means have respective cylindrical axes, said respective cylindrical axes being disposed at an angle less than 90 degrees therebetween.

9. The vacuum shield attachment of claim 7, wherein said vacuum coupling means is adapted to permit rotation of said vacuum hose with respect to said safety shield means.

* * * * *